US006354220B1

(12) United States Patent
Graham et al.

(10) Patent No.: US 6,354,220 B1
(45) Date of Patent: Mar. 12, 2002

(54) UNDERWATER EXPLOSIVE DEVICE

(75) Inventors: Kenneth J Graham, Warrenton; Edna M. Williams, Chester Gap, both of VA (US)

(73) Assignee: Atlantic Research Corporation, Gainesville, VA (US)

( * ) Notice: Subject to any disclaimer, the term of this patent is extended or adjusted under 35 U.S.C. 154(b) by 0 days.

(21) Appl. No.: 09/502,773

(22) Filed: Feb. 11, 2000

(51) Int. Cl.[7] ..... F42B 15/10; F42B 12/46
(52) U.S. Cl. ..... 102/374; 102/363; 102/364
(58) Field of Search ..... 102/374, 363, 102/364, 301

(56) References Cited

U.S. PATENT DOCUMENTS 2,809,585 A 10/1957 Moses
2,845,025 A 7/1958 Stark
5,107,768 A 4/1992 Langenohl
5,212,343 A * 5/1993 Brupbacher et al. ..... 102/323
5,411,615 A * 5/1995 Sumrail et al. ..... 149/47
5,468,313 A * 11/1995 Wallace, II et al. ..... 149/53
5,529,649 A * 6/1996 Lund et al. ..... 149/19.3

* cited by examiner

*Primary Examiner*—Michael J. Carone
*Assistant Examiner*—Aileen J. Baker
(74) *Attorney, Agent, or Firm*—Nixon & Vanderhye P.C.; Frank P. Presta

(57) ABSTRACT

An underwater explosive device, comprising a first container containing an explosive suitable for underwater use, and a second container surrounding the first container and containing oxygen gas under a pressure sufficient to enhance the underwater explosive reaction of the explosive.

13 Claims, 1 Drawing Sheet

UNDERWATER EXPLOSIVE DEVICE

BACKGROUND OF THE INVENTION

The present invention relates to an underwater explosive device and, more particularly, to a new and improved explosive device for underwater applications which is constructed to increase the extent of reaction, the pressure, temperature and bubble energy.

Underwater explosions rely on two different characteristics for damage mechanisms—shock and bubble. The shock parameter is driven by the detonation pressure of the explosive—which can be estimated from the plate dent test (although products density complicates this measurement). The shockwave shatters targets that are relatively close to the detonation. The bubble parameter, however, can be most damaging, especially to a surface target such as a destroyer. As the bubble rises, it alternately overexpands and then contracts in the water, sending out a pressure pulse on each oscillation. The greater amount of gas in the bubble and the hotter the product gases contained therein, the more effective it is for damaging a target.

For metallized explosives to achieve the hottest product gases at the highest temperature, and to give the biggest bubble requires that oxidation be complete and to be completed in a time period that matches the kinetics of the reactions. Expansion of the bubble lowers the pressure and temperature and slows (and then kinetically freezes) the reactions. Any process that requires significant mixing time will be detrimental to achieving maximum reaction output. Thus, although water can be an acceptable oxidizer for the fuel-rich products of detonation, there is a significant penalty because of the difficulty in mixing gaseous reaction products with the liquid water as the bubble expands. The water is pushed back instead of mixing with the hot gases. Even adding solid oxidizer particles to the explosive formulation does not give optimum results.

Accordingly, a need has arisen for an underwater explosive device which is not subject to the disadvantages of existing underwater explosives and possesses increased performance with respect to shock and bubble characteristics. The underwater explosive device of the present invention meets this need.

SUMMARY OF THE INVENTION

The underwater explosive device of the present invention comprises a suitable explosive for underwater use surrounded by oxygen gas under high pressure. This construction is advantageous for a number of reasons. First, the oxygen gas is not in and of itself a hazardous material. While it supports combustion, it is not combustible. Second, tank technology is available to house oxygen gas at high pressures such as 4350 psia. Third, and most importantly, the addition of high pressure oxygen has the capability to magnify the explosive effects of an underwater explosive, such as a titanium, magnesium or aluminum-loaded explosive, allowing for a small charge to appear much bigger. The gas-gas reactions are quick enough to significantly enhance bubble gas volume and temperature of the explosive reaction.

DESCRIPTION OF THE PREFERRED EMBODIMENTS

Figure 1:
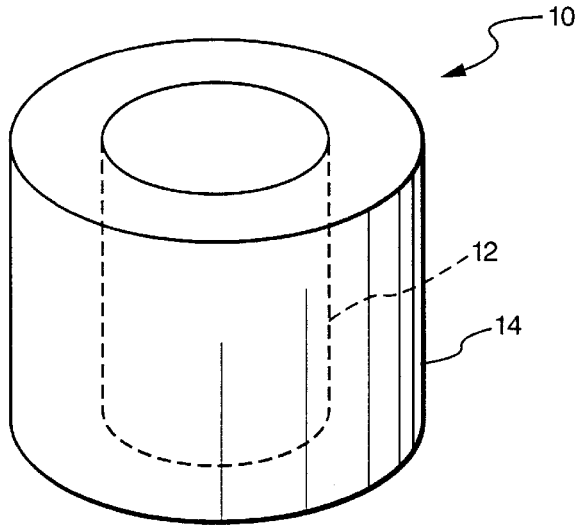
FIG. 1 is a schematic view of an underwater explosive device constructed in accordance with the principles of the present invention.

As shown in FIG. 1, the underwater explosive device 10 of the present invention comprises a first container 12 containing a suitable underwater explosive, and a second container 14 surrounding the explosive container 12. The second container has oxygen gas therein under high pressure. The containers 12 and 14 may be of any suitable shape or construction, and may be formed of suitable materials of high strength, such as steel or titanium, or of a material reactive in an explosion, such as titanium, magnesium or aluminum.

The explosive in container 12 may be any suitable type of underwater explosive, such as a high energy titanium, magnesium or aluminum loaded explosive. Examples of such explosives are PBXN-109, PBX-109Ti or PBX-109TiAl. The generic compositions of such explosives are as follows:

PBXN-109

RDX, 64–65% by weight;

Aluminum, 20% by weight;

Polymeric binder, balance.

PBX-109Ti

RDX, 64–65% by weight;

Titanium, 20% by weight;

Polymeric binder, balance.

PBX-109TiAl

RDX, 64–65% by weight;

Titanium-Aluminide, 20% by weight;

Polymeric binder, balance.

PBX-109Ti is a preferred explosive for the reason that it is less shock sensitive than and has better performance than PBXN-109. Also, PBX-109Ti is a good internal blast explosive that provides excellent underwater bubble energy, especially when surrounded by gaseous oxygen under pressure.

It is noted that other types of high energy, underwater explosives could be used in the present invention, depending on the nature and intended use of the explosive device 10.

The container 14 contains oxygen gas under high pressure in the range of approximately 1000 psia to 5000 psia. A preferred oxygen pressure is approximately 4350 psia which improves the performance of the explosive in a manner to be described hereinafter and also is capable of being stored with present container or tank technology.

The provision of the high pressure oxygen gas surrounding the underwater explosive serves to magnify the explosive effects of the explosive to enable a small charge to perform like a larger charge. Accordingly, less explosive can be used in the underwater explosive device of the present invention than in current underwater explosive devices.

Figure 2:
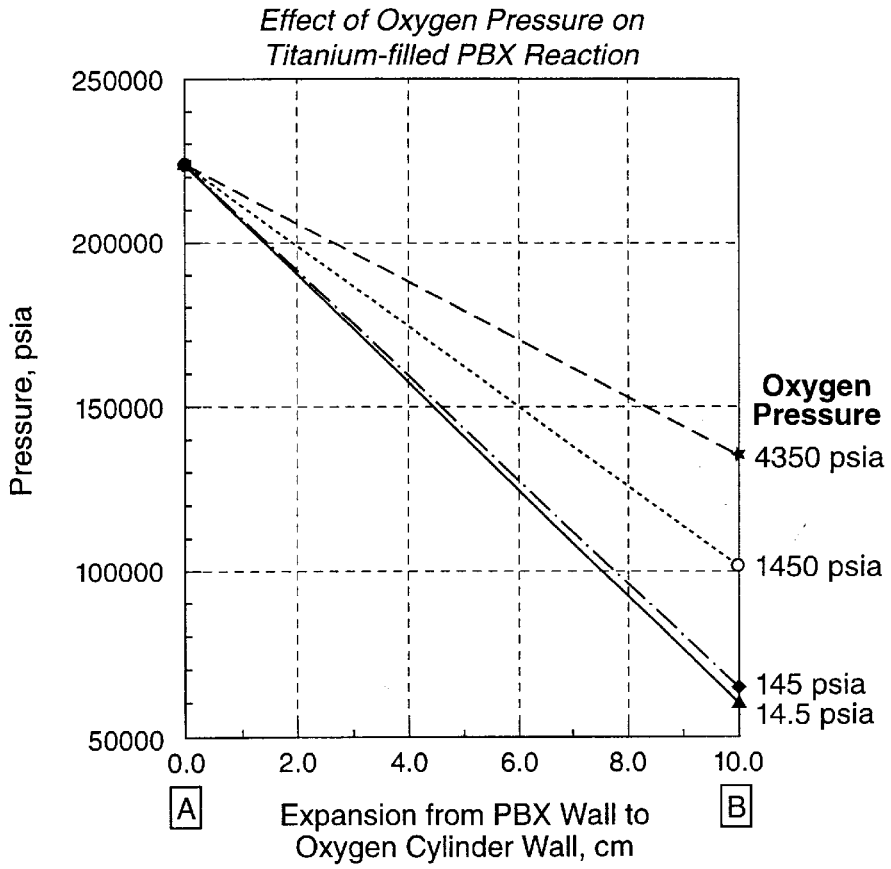
FIG. 2 is a graph showing the effect of oxygen pressure on underwater explosive reactions.

The graph in FIG. 2 illustrates the effect of oxygen pressure on the explosive reaction of PBX-109Ti explosive wherein 20% by weight Ti is substituted for the 20% aluminum in the explosive PBXN-109.

Calculations were run at 1, 10, 100 and 300 bars (14.5, 145, 1450, and 4350 psia) of oxygen in the surrounding container 14 shown in FIG. 1. For the constant volume explosion of the 20% Ti analog of PBXN-109, the pressure at point "A" was 223,000 psi. When expanded with only 1 bar of oxygen in the surrounding container, the pressure fell to 60,000 psi at point "B" and the resultant temperature was 2941 K. However, if the container 14 were filled with oxygen at 300 bars (4350 psia), the pressure at point "B" was 135,000 psia and the temperature was 4989 K.

It will be readily seen, therefore, that the provision of the surrounding pressurized oxygen gas in the underwater explosive device 10 of the present invention serves to enhance the explosive reaction with respect to both bubble gas volume and temperature.

Referring to FIG. 1, as an illustrative example, if the explosive container were of cylindrical form with a diameter of approximately 50 cm and a height of approximately 100 cm, the second annular container filled with oxygen gas at 4350 psia would have a length of approximately 100 cm and a radial width of approximately 25 cm. The relative size of the containers 12 and 14 would depend on the explosive used, the pressure of the oxygen gas and the intended use of the explosive device 10.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. An underwater explosive device comprising:

a first container containing an explosive suitable for underwater use; and a second container surrounding said first container and containing oxygen gas under a pressure sufficient to enhance the underwater explosive reaction of said explosive when it is ignited.

2. The explosive device of claim 1 wherein said first container is of generally cylindrical configuration, and said second container is of generally annular configuration surrounding said first container.

3. The explosive device of claim 1 wherein said oxygen gas is under a pressure of approximately 1000 psia to 5000 psia in said second container.

4. The explosive device of claim 3 wherein said oxygen gas is under a pressure of approximately 4350 psia in said second container.

5. The explosive device of claim 1 wherein said explosive is selected from the group consisting of PBXN-109, PBX-109Ti and PBX-109TiAl.

6. The explosive device of claim 1 wherein said explosive is PBX-109Ti, and said oxygen is under a pressure of approximately 100 psia to 5000psia in said second container.

7. The explosive device of claim 6 wherein said oxygen gas is under a pressure of approximately 4350 psia in said second container.

8. The explosive device of claim 1 wherein said explosive is a metallized explosive.

9. The explosive device of claim 8 wherein said metallized explosive is a PBX plastic bonded explosive.

10. The explosive device of claim 9 wherein said PBX plastic bonded explosive contains titanium, magnesium or aluminum powder.

11. The explosive device of claim 10 wherein said explosive contains approximately 20% by weight titanium, magnesium or aluminum powder.

12. The explosive device of claim 9 wherein said PBX plastic bonded explosive contains titanium powder.

13. The explosive device of claim 12 wherein said explosive contains approximately 20% by weight of titanium powder.

* * * * *